US006481933B1

(12) United States Patent
Dettmers et al.

(10) Patent No.: US 6,481,933 B1
(45) Date of Patent: Nov. 19, 2002

(54) POWERED SUPPORT FRAME FOR LARGE SEAM THICKNESSES WITH CONTROLLED GAP SEALING PLATES

(75) Inventors: Michael Dettmers, Kamen (DE); Ulrich Hilker, Lünen (DE)

(73) Assignee: DBT Deutsche Bergbau-Technik GmbH (DE)

( * ) Notice: Subject to any disclaimer, the term of this patent is extended or adjusted under 35 U.S.C. 154(b) by 0 days.

(21) Appl. No.: 09/706,941

(22) Filed: Nov. 6, 2000

(30) Foreign Application Priority Data

Nov. 5, 1999 (DE) ..... 199 53 526

(51) Int. Cl.[7] ..... E21D 17/00; E21D 15/44

(52) U.S. Cl. ..... 405/296; 299/11; 299/12

(58) Field of Search ..... 405/296, 288, 405/290, 291, 292, 293, 294, 295, 297, 299, 300, 301, 302; 299/11, 12

(56) References Cited

U.S. PATENT DOCUMENTS 3,739,586 A * 6/1973 Wehner et al. ..... 405/295
3,837,170 A * 9/1974 Martinko et al. ..... 405/295
3,911,686 A * 10/1975 Becker et al. ..... 405/295
4,010,618 A * 3/1977 Walker et al. ..... 405/295
4,092,831 A * 6/1978 Lubojatsky et al. ..... 405/295
4,217,067 A * 8/1980 Lagodka et al. ..... 405/296
4,293,247 A * 10/1981 Rosenberg et al. ..... 405/296
4,432,673 A * 2/1984 Buckmaster ..... 405/298
4,586,851 A * 5/1986 Watermann ..... 405/295

FOREIGN PATENT DOCUMENTS

DE 2822368 * 5/1978

* cited by examiner

*Primary Examiner*—Heather Shackelford
*Assistant Examiner*—Frederick L. Lagman
(74) *Attorney, Agent, or Firm*—Cook, Alex, McFarron, Manzo, Cummings & Mehler, Ltd.

(57) ABSTRACT

It is provide in a powered support frame, for large seam thicknesses with controlled gap sealing, that double acting gap cylinders (16, 27, 30) of several gap sealing elements (15) on a powered support frame are connected to a common pressure feed line (34, 37, 39) and to a common pressure return line (50) and are impacted with a uniform pressure when the gap sealing elements are to be extended.

11 Claims, 4 Drawing Sheets

POWERED SUPPORT FRAME FOR LARGE SEAM THICKNESSES WITH CONTROLLED GAP SEALING PLATES

THE FIELD OF THE INVENTION

The present invention relates to a powered support frame, especially in the form of a shield support, with a roof cap, a gob shield and a linking arrangement to join the gob shield to a ground frame, whereby the powered support frame is provided on both sides on its roof cap and on its gob shield with a laterally extensible gap sealing plate element and with at least one gap cylinder, configured as a hydraulic cylinder, to extend the gap sealing plate elements.

A powered support frame with the above features is described in DE 28 22 368 A1; the powered support frame has a laterally extensible gap sealing plate arranged both on the roof cap and on the gob shield. In each case a hydraulic positioning cylinder is provided for the lateral extension of the gap sealing element concerned.

The gap sealing elements serve not only for the sealing of a gap arising between two support frames, against rock fall from the roof and from breaking out in the case of face equipment, but also for the alignment of the individual support frames normal to the stratification between the roof and the floor on the one hand, and in the direction of face advance to their halt against a face conveyor on the other hand, so that when the face conveyor connected to their advancing mechanisms moves, the support frames can follow on a preferred line.

There is the problem, especially in support frames provided for very large seam thicknesses, for instance between 3 meters and 6 meters, that the alignment of the individual support frames is difficult to handle using the individual controls for each positioning cylinder for each gap sealing element. This problem is exacerbated if saddles and troughs occur and/or the floor undulates in the direction of the mining. In difficult mining conditions of this type the adjacent support frames must be aligned on the one hand convergent, and on the other divergent, so that the support frames can have, for instance in the region of their gob shields, a substantially smaller separation from each other than in the region of their roof caps.

SUMMARY OF THE INVENTION

The present invention therefore has the aim of improving a powered support frame as previously described, such that even with very large seam thicknesses a good alignment of the support frames to the face conveyor is simple to contrive.

In accordance with the present invention, double acting gap cylinders of the gap sealing elements are connected to a common pressure feed line and to a common return line and are activated with a uniform working pressure when the gap sealing elements are to be extended, so that all the gap cylinders, joined and communicating with each other, of the gap sealing elements on a support frame for bridging a gap to an adjacent support frame, effect a floating activation of the individual gap sealing elements until they impact on the gap sealing elements of the adjacent support frame. Owing to the connection of all the gap cylinders to a uniform pressure supply with the prescribed working pressure each gap cylinder extends the gap sealing element connected to it as far to the side until, under the prescribed pressure, this abuts the adjacent support frame or its extended gap sealing element. In this manner the work requirement for the alignment of the individual regions of individual support frames is avoided, since the support frames, owing to the floating actuation of their lateral gap sealing elements, automatically assume their optimum positions with respect to each other.

In accordance with one embodiment of the invention, in the region of the linking arrangement an additional gap sealing element is provided, so that especially with large seam thicknesses, an additional sealing and alignment facility is provided.

Possibly, several gap cylinders are provided, distributed over the extent of each gap sealing element.

For very large seam thicknesses, the gaps arising between adjacent support frames can become so large when saddles and troughs occur in the direction along the face, that the working region of an individual hydraulic cylinder of conventional design is insufficient. Therefore, according to one embodiment of the invention, for the extension of each gap sealing element a gap cylinder arrangement is provided comprising two individual cylinders arranged in series with each other, with one inner cylinder and one outer cylinder with respect to the center line of the support frame. The working range of the gap cylinder arrangement is thereby increased in an advantageous manner with respect to the alignment of the support frames to each other and to the face conveyor. Possibly, on the pressure side the inner cylinder is connected to a common pressure feed line and the outer gap cylinder to a further common pressure feed line, and on the return side the inner gap cylinder and the outer gap cylinder are connected to a common return line.

With regard to especially difficult deposit conditions, this increase in the working range can also be used to reduce the normal width of an individual support frame, and to configure the working region of the two gap cylinders positioned on either side so that the inner gap cylinders in their extended position first set the normal width of a support frame. Further to this, the possibility still exists of undertaking the necessary alignment of the support frame using the working range of the outer gap cylinder.

According to one embodiment of the invention it is proposed that the inner gap cylinder and the outer gap cylinder can be actuated by the working pressure in a time sequence, whereby a non-return valve is arranged between the pressure supply and the first, inner, gap cylinder. Thereby, the inner gap cylinder can first be extended and established in the required extended condition by the non-return valve; following this the alignment of the support frame concerned can be undertaken by controlling the outer gap cylinder by means of a separate valve arrangement.

Alternatively, the inner gap cylinder and the outer gap cylinder can be simultaneously charged with the working pressure. In this case all the gap cylinders of the currently realised gap cylinder arrangements extend over their working range depending on the gap to be bridged, so that thereby even extreme convergences or divergences can be bridged.

With regard to relieving the load due to cross forces arising on individual gap cylinders, in accordance with one embodiment of the invention the gap sealing elements are guided by means of bolt guides on an associated component of the support frame. This construction of guidance of a gap sealing element on a component of a support frame carrying it is described in outline in DE 28 53 050 C2. Here, however, a longitudinal boring, carrying the guiding bolts, is arranged in the associated component of the support frame and is thus poorly accessible and difficult to assemble. It is therefore proposed that the gap sealing elements, formed in an angle-shape, have, on arms aligned to the component of the support frame carrying them, sleeving attachments with a longitudinal boring arranged in them, which engages so as to encompass a bolt arranged on the component. Additionally, in the longitudinal boring of the attachment, a pressure spring can be arranged supporting itself between the deepest parts of the longitudinal boring and the component, engaging around the outside of the bolt and guided by the bolt against buckling.

BRIEF DESCRIPTION OF THE DRAWINGS

An embodiment of the invention, which is described below, is shown in the drawings, wherein.

DESCRIPTION OF THE PREFERRED EMBODIMENTS

Figure 1:
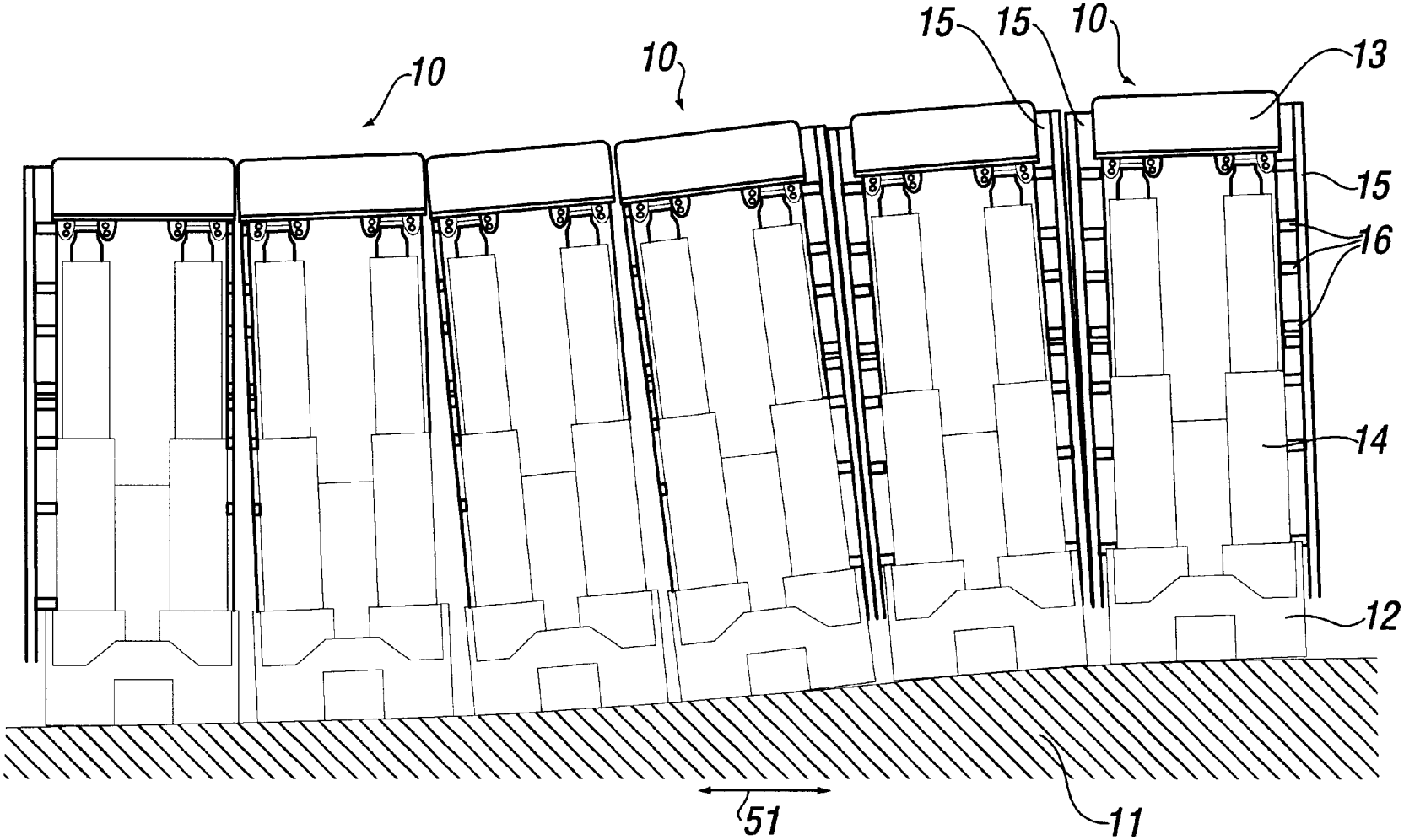
FIG. 1 is a section of a face installation comprising several support frames arranged adjacent to each other in a front view as seen from the face.

The front view, which can be seen in FIG. 1, of a part of a face installation, shows six adjacently arranged support frames 10, whose ground frames 12 stand in the direction along the face (double arrow 51) upon an undulating, i.e. with saddles and troughs, bottom wall 11. Props 14 are supported on the ground frame 12, which carry a roof cap 13. Each support frame 10 is equipped on both sides with gap sealing elements 15, which can be extended sideways, using individually arranged gap cylinder arrangements 16, to the adjacent installation, so that an alignment of the support frame 10, converging and diverging to the roof, can be effected.

Figure 2:
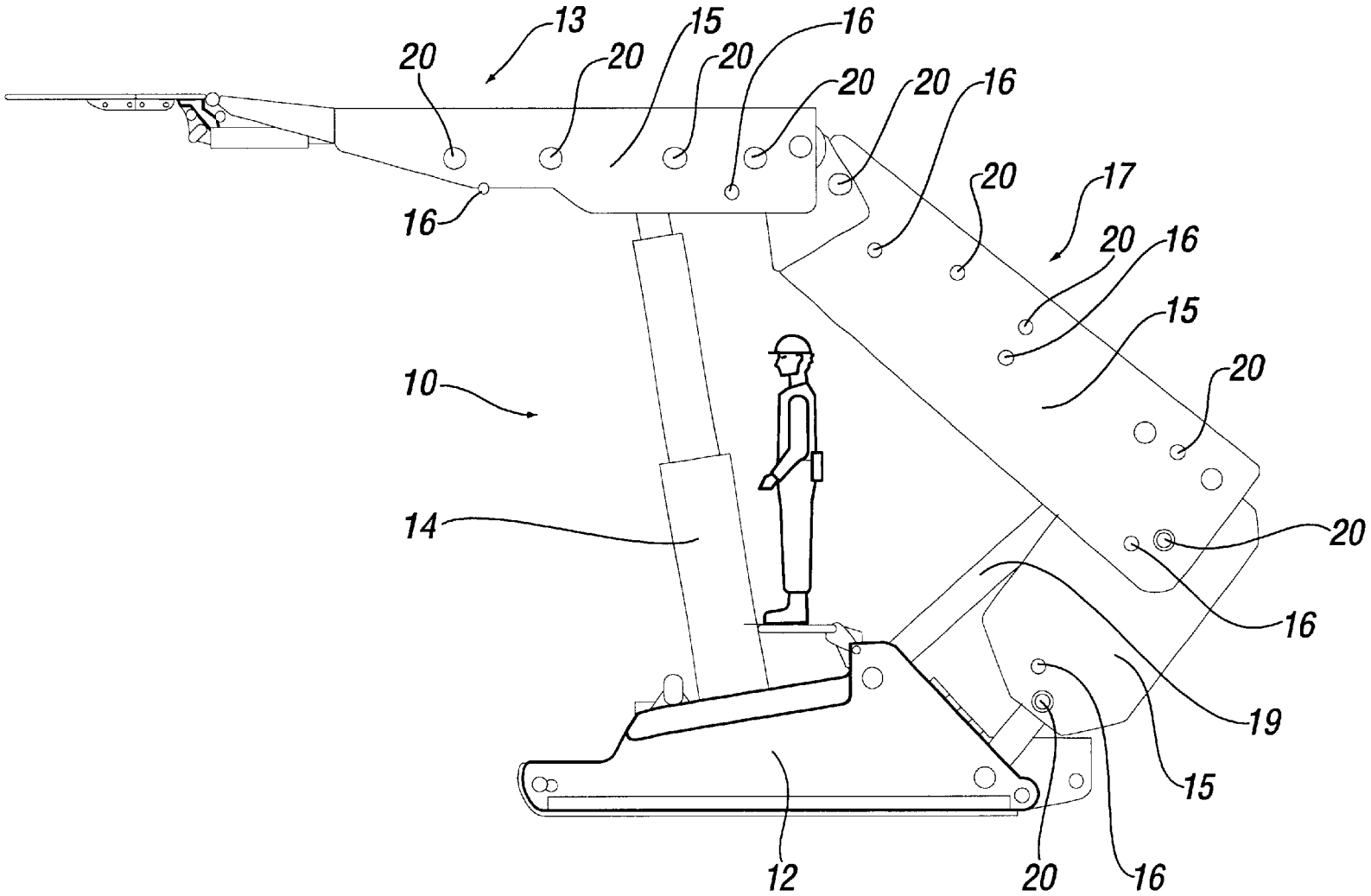
FIG. 2 is an individual support frame in a side view.

As is more clearly seen from FIG. 2, a first gap sealing element 15 is arranged in the region of the roof cap 13, shown formed in several parts in the embodiment depicted; a further gap sealing element 15 is positioned in the region of the gob shield 17, and finally a gap sealing element 15 is also arranged on the guide bars 19 joining the ground frame 12 to the gob shield 17. The gap sealing elements 15 are retained on the components 13, 17, 19 of the support frame 10 carrying them by gap cylinder arrangements 16 and can extend sideways, whereby to relieve the gap cylinder arrangements 16 from cross forces, bolt guides 20 are arranged between each gap sealing element 15 and the associated component 13, 17, 19 of the support frame 10, which can be seen in detail in FIG. 3.

On the associated component of the support frame, in this case a gob shield 17, the gap sealing elements 15, angularly formed with an upper abutment arm 21 and an alignment arm 22, are arranged on both sides so as to slide, whereby the alignment arm 22 of the gap sealing element 15 has an attachment 23 extending inside it, and projecting to the gob shield 17, and having a longitudinal boring 24, which engages around a bolt 25, fastened to an intermediate wall 18 of the gob shield 17, and is guided by positive engagement on it. In the longitudinal boring 24 a pressure spring 26 is arranged, supported against the deepest part of the longitudinal boring 24 at one end and against the intermediate wall 18 at the other end, which is guided on the outer periphery of the bolt 25 and is thereby secured against buckling. As already realised in the gap sealing described in DE 28 53 050 C2, the pressure spring 26 pretensions the individual gap sealing element 15 in its extended position, so that activation of the gap cylinder, comprising double acting cylinders 27, 30, generates the necessary pressure against each other for the active alignment of the support frame 10 in the extending direction, whilst on controlling the gap cylinders 27, 30 in the direction of retraction the spring force of the pressure spring 26 has always to be overcome.

Figure 3:
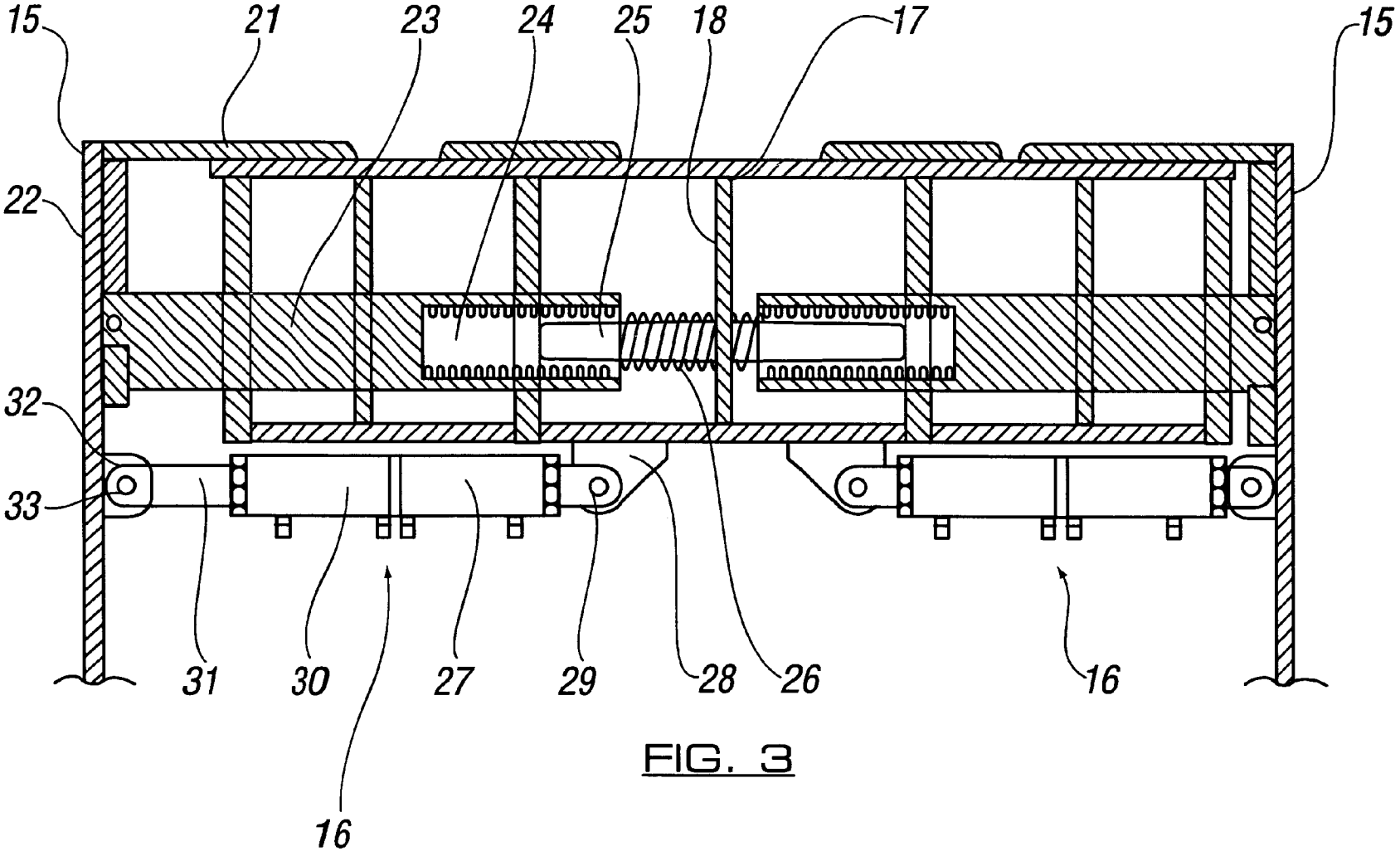
FIG. 3 is an arrangement of two gap sealing elements on both sides of a support frame in an embodiment on a gob shield.

FIG. 3 shows further detail of the gap cylinder arrangement 16 for extending the associated gap sealing element 15, which comprises two individual cylinders arranged in series, namely an inner gap cylinder 27 and an outer gap cylinder 30, which are supported against each other. The piston rod of the inner gap cylinder 27 is attached to a tongue 28 fastened by means of a fastener 29 to the gob shield 17, whilst the piston rod 31 of the outer gap cylinder 30, the latter firmly fixed to the inner gap cylinder 27, is fastened to a tongue 32 on the alignment arm 22 of the gap sealing element 15 by means of a fastener 33. The right-hand half of FIG. 3 shows the right-hand gap sealing element 15 fully retracted, whilst the left-hand part of FIG. 3 shows a partly extended, that is by means of the outer gap cylinder 30, gap sealing element 15 of the gob shield 17.

Figure 4:
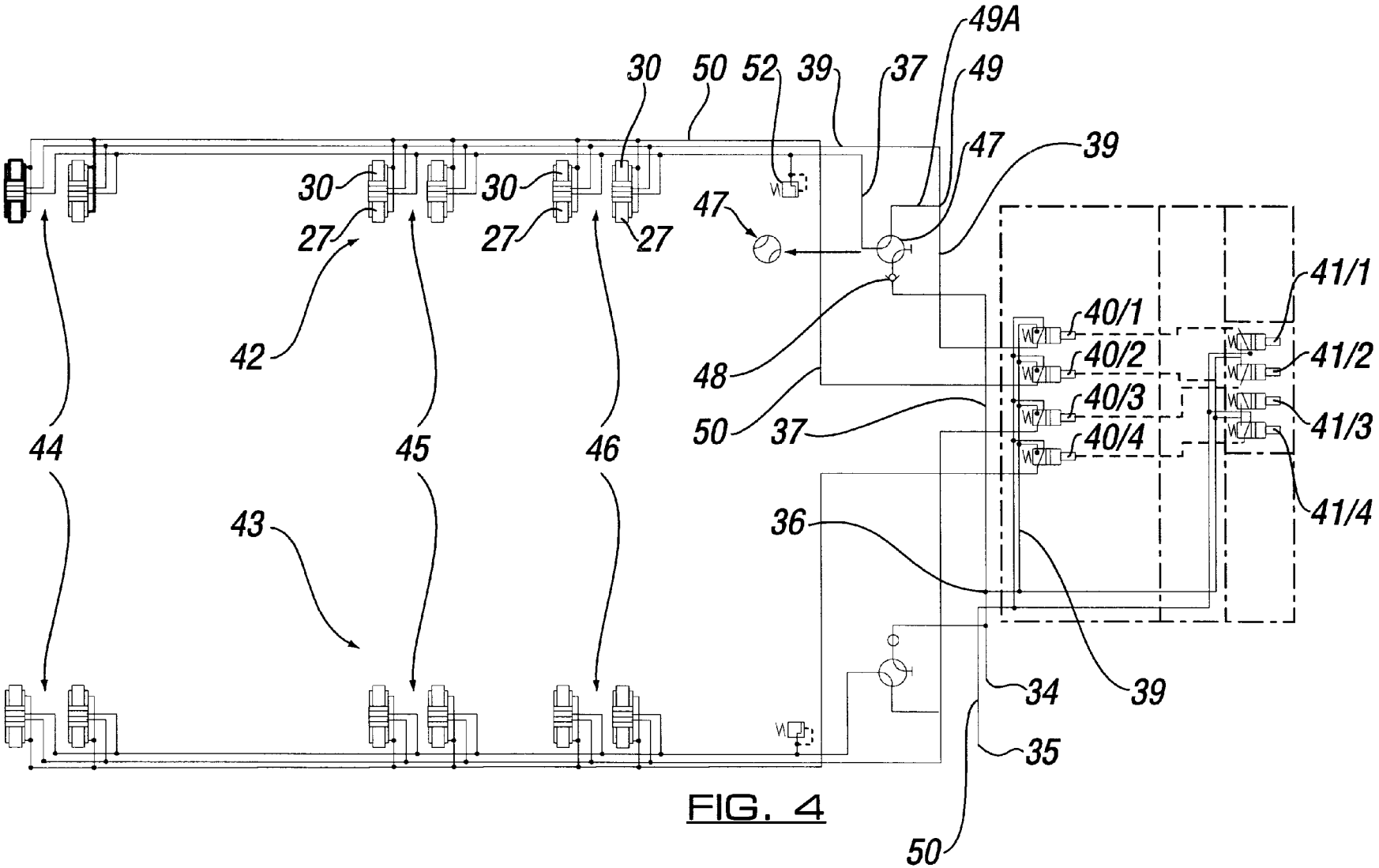
FIG. 4 is a hydraulic circuit plan in a simplified representation for the control of the gap cylinder arrangement present on a support frame.

The circuit plan depicted in FIG. 4 for the control of the gap cylinder arrangements 16 and the individual gap cylinders 27, 30 shows the gap cylinder arrangements 16 for the left-hand side 42 of a support frame, and for its right-hand side 43, with the gap cylinder arrangement 44 for the roof cap 13, the gap cylinder arrangement 45 for the gob shield 17, and the gap cylinder arrangement 46 for the region of the guide bars 19.

All the gap cylinder arrangements are supplied from a central pressure feed 34, which divides in a branching 36 into a pressure feed line 37 for the inner cylinders 27 in each case, and into a pressure feed line 39 for the supply to the outer cylinders 30, whereby a valve arrangement is connected into the pressure feed line 39, comprising pilot valves 41 and main valves 40.

A non-return valve 48 and a ball valve 47 are connected into the pressure feed line 37 for the supply to the inner gap cylinders 27, whereby through a second switch position of the ball valve 47 a connection between the pressure feed line 37 for the inner cylinder 27 and the pressure feed line 39 for the outer cylinder 30 can also be set up to a branching 49 and a branch line 49*a*.

All the gap cylinders 27, 30 of all the gap cylinder arrangements are connected to a common return line 50, which leads via the valve arrangement 40, 41 to the return. The circuit is completed by a pressure limiting valve 52 connected to the pressure feed line 37 for the inner cylinder 27.

The circuit condition illustrated in FIG. 4 shows the starting position, in which the gap cylinders 27, 30 are actuated on the pressure side in the retracting direction, so that the gap cylinders 27, 30 overcome the force of the pressure springs 26, which are pre-tensioned in the extending direction of the gap sealing elements 15 and hold the gap sealing elements 15 always in contact with the associated components 13, 17, 19 of the support frame 10. To this end the pressure feed 34 is connected via the valve arrangement 40, 41 to the line designated return line 50, so that through this control the side of the piston working in the direction of retraction in the individual gap cylinders 27, 30 is impacted with pressure; in this switching condition the lines designated as pressure feed lines 37, 39 work as return lines and are connected via the valve arrangements 40, 41 to the return 35. Also shown is the position of the ball valve 47, which joins the line 37 to the line 39, so that a common return is effected.

If the gap sealing elements 15 are now to be extended, in a first step the ball valve 47 can be switched to the position shown separately in FIG. 4, in which the connection between the inner gap cylinders 27 and the pressure feed line 34 is set up via the ball valve 47 and the non-return valve 48; in this control phase the valve arrangement 40, 41 still blocks the pressure feed line 39 to the outer gap cylinders 30. If the inner gap cylinders 27 are extended, then they are locked in their final position by the hydraulic fluid return flow being prevented by the non-return valve 48. In a second switching step the associated main valve 40/1 and 40/3 are brought via the pilot valve 41/1 and 41/3 into that circuit position in which the pressure feed line 39 is switched through to the outer gap cylinders 30, and in this position the outer gap cylinders 30 are charged with the working pressure, so that they actuate the gap sealing elements correspondingly. At the same time the return line 50 common to all the gap cylinders 27, 30 is connected via the main valve 40/2 and 40/4 to the return 35.

If, during the control effecting the extension of the gap cylinders 27, 30, the position of the ball valve 47 is retained in the position shown in the circuit plan, then the inner gap cylinders 27 and the outer gap cylinders 30 are connected simultaneously and together to the central pressure source 34, so that in each case alignment of the gap sealing elements 15 is effected by both individual cylinders of the gap cylinder arrangement. In this setting the connection between the pressure feed 34 and the pressure feed line 37 is blocked to the inner gap cylinders 27, whereby in this setting of the ball valve 47 the pressure feed line 37 is connected to the pressure feed line 39 via the branch line 49*a* and the branching 49. If now a suitable switching of the main valve 40 onto the pressure feed line 34 is made, then both the inner gap cylinder 27 and the outer gap cylinder 30 lie together and simultaneously on the pressure feed line 34.

What is claimed is:

1. A powered support frame, especially in the form of a shield support, with a roof cap, a gob shield and a guide bar arrangement to join the gob shield to a ground frame, whereby the support frame is provided on both sides on its roof cap and on its gob shield with in each case a sideways extensible gap sealing element, and for the extension of each gap sealing element at least one gap cylinder, configured as a hydraulic cylinder and being double acting, is arranged, in which the gap cylinders of the several gap sealing elements are connected to a common pressure feed line and to a common return line and are impacted with a uniform working pressure when the gap sealing elements are to be extended, so that all the connected, mutually communicating gap cylinders of the several gap sealing elements to be found on a support frame effect a floating actuation of the individual gap sealing elements to bridge a gap to an adjacent support frame up to the abutment onto the gap sealing element of the adjacent support frame.

2. A powered support frame according to claim 1, in which an additional gap sealing element is provided in each case in the region of the guide bar arrangement.

3. A powered support frame according to claim 1, in which several gap cylinders are arranged along the extent of each gap sealing element.

4. A powered support frame according to claim 1, in which for the extension of each gap sealing element a gap cylinder arrangement is provided comprising two individual cylinders arranged in series with each other, being an inner gap cylinder and an outer gap cylinder, with respect to the center line of the powered support frame.

5. A powered support frame according to claim 4, in which on their pressure side, the inner gap cylinders are connected to a common pressure feed line and the outer cylinders to a further common pressure feed line and on their return side the inner gap cylinders and the outer gap cylinders are connected to a common return line.

6. A powered support frame according to claim 4, in which the inner gap cylinder and the outer gap cylinder can be impacted with the working pressure in a time sequence.

7. A powered support frame according to claim 6, in which a non-return valve is connected between the pressure feed and the first inner gap cylinder.

8. A powered support frame according to claim 4, in which the inner gap cylinder and the outer gap cylinder can be impacted with the working pressure simultaneously.

9. A powered support frame according to claim 1, in which the gap sealing elements are guided on the associated component of the powered support frame by means of bolt guides.

10. A powered support frame according to claim 9, in which the gap sealing elements are configured as angle shapes having alignment arms with attachments extending to the component of the powered support frame and having a longitudinal boring in the attachments which engages and surrounds a bolt arranged on the component.

11. A powered support frame according to claim 10, in which in the longitudinal boring of the attachment a pressure spring is arranged supported between the deepest part of the longitudinal boring and the component, the spring engaging the bolt on its outside and being protected against buckling by the bolt.

* * * * *